US005996124A

United States Patent [19]

Asp, Jr.

[11] Patent Number: 5,996,124

[45] Date of Patent: Dec. 7, 1999

[54] CAP WITH INTEGRATED STORAGE POUCHES

[76] Inventor: Harold K. Asp, Jr., 3108 Kingsway Rd., Seffner, Fla. 33584

[21] Appl. No.: 09/022,090

[22] Filed: Feb. 11, 1998

[51] Int. Cl.[6] ..... A42B 1/06; A42B 1/24

[52] U.S. Cl. ..... 2/209.13; 2/172

[58] Field of Search ..... 2/172, 209.13, 2/175.1, 175.6, 195.1

[56] References Cited

U.S. PATENT DOCUMENTS

| | | | |
|---|---|---|---|
| D. 300,080 | 3/1989 | Wyatt | D2/866 |
| D. 333,375 | 2/1993 | Ouellette | D2/866 |
| D. 370,334 | 6/1996 | Stevenson et al. | D2/882 |
| 2,795,890 | 6/1957 | Metsker | 43/57.1 |
| 3,546,709 | 12/1970 | Cross . | |
| 4,312,076 | 1/1982 | Gamm . | |
| 5,548,847 | 8/1996 | Spicijaric | 2/209.13 |
| 5,581,813 | 12/1996 | Henshel | 2/195.1 |

*Primary Examiner*—Diana Oleksa
*Attorney, Agent, or Firm*—John D. Gugliotta

[57] ABSTRACT

Disclosed is an otherwise conventional sports cap-like hat with two weatherproof, zippered pouches for storing and transporting personal items such as keys, wallets, money, etc. attached to the rear portion thereof.

5 Claims, 6 Drawing Sheets

CAP WITH INTEGRATED STORAGE POUCHES

BACKGROUND OF THE INVENTION

1. Field of the Invention

The present invention relates generally to sporting clothing and apparel and, more particularly, to a sportsman's cap with zippered, weatherproof storage pouches attached thereto.

2. Description of the Related Art

A common problem associated with participating in outdoor sporting activities such as hunting, fishing, camping, hiking, running and the like relates to storage of personal items such as keys, wallets, money and other miscellaneous personal items. People tend to lose these items because of the loose fitting clothing and the frequent, vigorous body movements associated with these activities. Furthermore, wading in streams and lakes as well as exposure to rainy weather can lead to water infiltration of the one's pockets, thereby soaking, damaging and possibly ruining the contents thereof. Additionally, the clothing worn during some of these activities do not include a means to store these items (e.g. running shorts, etc.), thus prohibiting the carrying of personal items altogether. Accordingly, the need has arisen for an effective means for storing and carrying personal items that is both weatherproof and adaptable for use with the many types of clothing worn during varying outdoor sporting activities.

The present invention solves these and many other problems by providing a sports cap equipped with a pair of waterproof, zippered pockets that provide a means by which the wearer can carry his or her personal belongings during various outdoor activities. The pockets provide protection from the elements and can even withstand complete submersion in water. Available in a variety of different styles and colors, the present invention is a stylish accessory for virtually any type of sporting clothing outfit.

In the ancillary art, there are several hats and caps disclosed that include pockets and other means by which the wearer can transport various articles. U.S. Pat. No. 5,581,813, issued in the name of Henschel, discloses a cap with transparent pockets located on the cap just above the brim. The pockets are constructed of a transparent material and are intended to allow the wearer display an object therein. The intent and function of the cap disclosed in the Henschel patent is distinguishable from the present invention in several aspects. The pockets are located on the front of the cap, are intended for display purposes, and are not sealable, waterproof nor sufficient to carry personal items of the size anticipated by the present invention.

U.S. Pat. No. 5,548,847, issued in the name of Spicijaric, discloses a cap with transparent picture retaining pocket located on the cap just above the brim. The pocket is constructed of a transparent material and is intended to allow the wearer display an object therein. Access to the pocket is gained from the inside portion of the cap. The intent and function of such a cap is distinguishable from the present invention in several aspects. In the Spicijaric disclosure, the pocket is located on the front of the cap, is intended for display purposes, and is not sealable, waterproof nor sufficient to carry personal items of the size anticipated by the present invention.

U.S. Pat. No. 4,312,076, issued in the name of Gamm, discloses a cap with an integral pocket located on the cap just above the brim. The pocket is intended to allow the wearer to hold smaller sized personal items therein. Access to the pocket is gained through a flap secured to the cap by a hook and loop fastener device. The design and function of such a cap is distinguishable from the present invention in several aspects. In the Gamm disclosure, the pocket is located on the front of the cap, it is not waterproof, and it is not sufficient to carry personal items of the size anticipated by the present invention.

U.S. Pat. No. 3,546,709, issued in the name of Cross and U.S. Pat. No. 2,795,890, issued in the name of Metsker, disclose fishing hats with hat rings that are intended to allow the wearer to secure fishing hooks, lures and other tackle thereto. The Cross device utilizes a magnetic band to secure the tackle whereas the Metsker device consists of a belt designed to allow the wearer to attach the tackle thereto by inserting the hooks into a sponge material included thereon. The design and function of these hats is distinguishable from the present invention in several aspects. There are no pockets, it is not waterproof, and it is not intended to nor sufficient for carrying personal similar to those anticipated by the present invention.

U.S. Pat. No. Des. 333,375, issued in the name of Ouelette, discloses a cap with an integral pocket located on the back of the cap. The design and function of this cap is distinguishable from the present invention in several aspects. Although the inventor's intent is not disclosed, it is apparent from the figures that access to the pocket is gained through a flap. Furthermore, it is also apparent from the figures that the pocket is not of a size sufficient to accommodate personal items of the size anticipated by the present invention. Finally, the figures do not indicate any waterproof characteristics of the pouch.

U.S. Pat. No. Des. 300,080, issued in the name of Wyatt, discloses a fisherman's tackle hat with a series of integral pockets located around the hat body just above the rim. The pockets are intended to allow the wearer to hold fishing tackle therein. Access to the pocket is gained through a flap secured to the cap by a snap-type button fastener. The design and function of this cap is distinguishable from the present invention in several aspects. The pockets are not waterproof and are not sufficient to carry personal items of the size anticipated by the present invention.

A search of the previous art did not disclose any patents that read directly on the claims of the instant invention. Consequently, a need has been felt for providing a cap that can be worn during outdoor sporting activities that provides a secure, waterproof means by which the wearer can store his/her personal belongings.

SUMMARY OF THE INVENTION

It is therefore an object of the present invention to provide an improved cap for use when participating in outdoor sporting activities that includes storage pouches in which to store and transport the wearer's personal items.

It is another object of the present invention to provide an improved cap for use when participating in outdoor sporting activities wherein the storage pouches are waterproof so as to protect the items therein from damage caused by exposure to moisture, including complete submersion.

It is another object of the present invention to provide an improved cap for use when participating in outdoor sporting activities, wherein the storage pouches are of a size ample to store and transport personal items such as keys, wallets and money.

It is another object of the present invention to provide an improved cap for use when participating in outdoor sporting activities in a variety of styles and colors so as to allow for a fashionable accessory to varying sporting outfit styles.

It is another object of the present invention to provide an improved cap for use when participating in outdoor sporting activities that is adjustable so as to accommodate a variety of head sizes.

It is another object of the present invention to provide an improved cap for use when participating in outdoor sporting activities that shields the wearer's head and/or neck from exposure to sunlight.

Finally, it is an object of the present invention to provide an improved cap for use when participating in outdoor sporting activities that provides a comfortable fit regardless of whether the storage compartments thereof are empty or filled.

Briefly described according to a preferred embodiment, the present invention consists of a cap, of an otherwise conventional design, with a brim or visor and an adjustable headband so as to accommodate a variety of head sizes. Attached to the cap on the rear portion just above the headband adjustment mechanism are two waterproof, zippered pouches for storing and transporting personal items such as keys, wallets, money, etc. The compartments are arranged so as to mate with the cap body, following the dome-like contour of the cap structure. The compartments overlap each other in a manner such that a first, larger compartment is affixed against the cap body with a second, smaller compartment attached to the outside surface of the first compartment just below the zipper thereof.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

Figure 1:
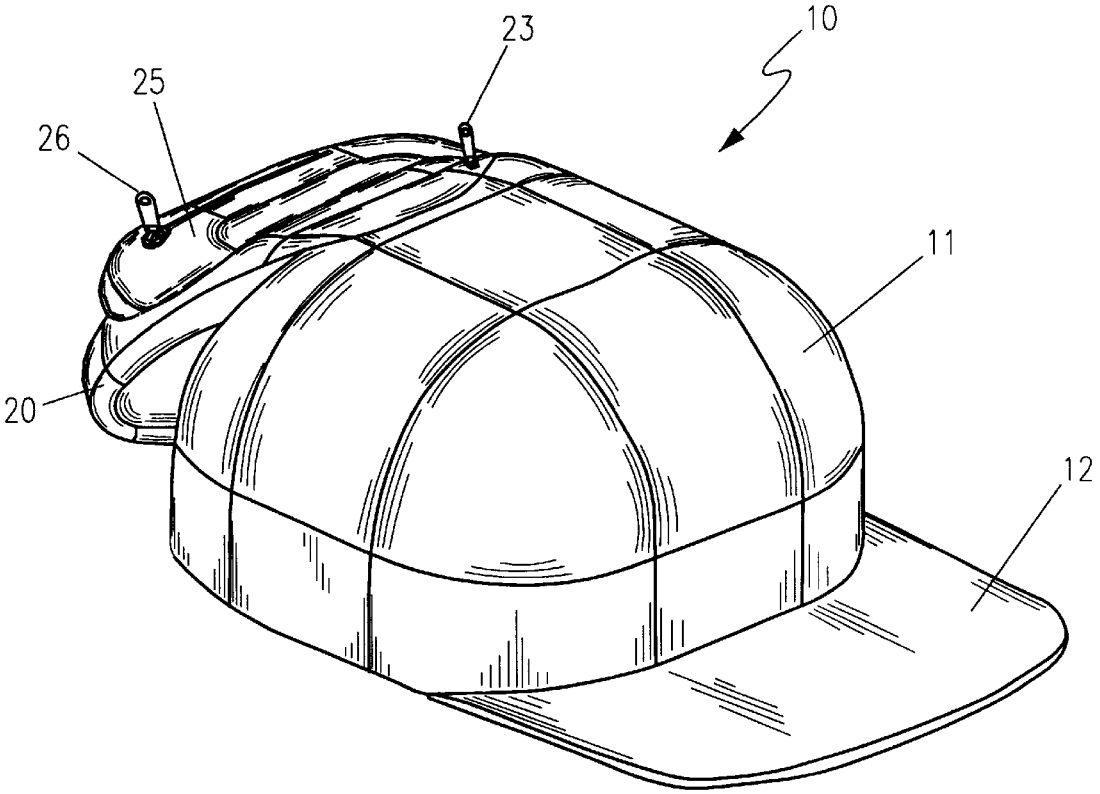
FIG. 1 is a perspective view depicting a top-frontal view of the cap with integrated storage pouches according to the preferred embodiment of the present invention.
Figure 2:
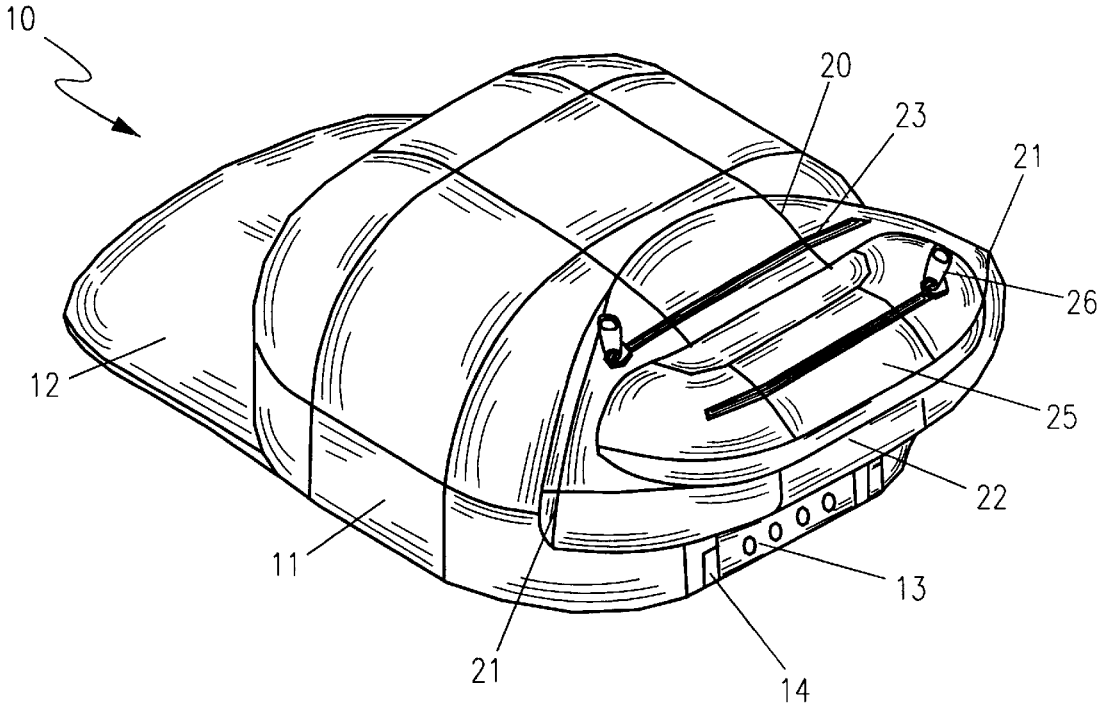
FIG. 2 is a perspective view depicting a top-rear view of the cap with integrated storage pouches according to the preferred embodiment of the present invention.
Figure 3:
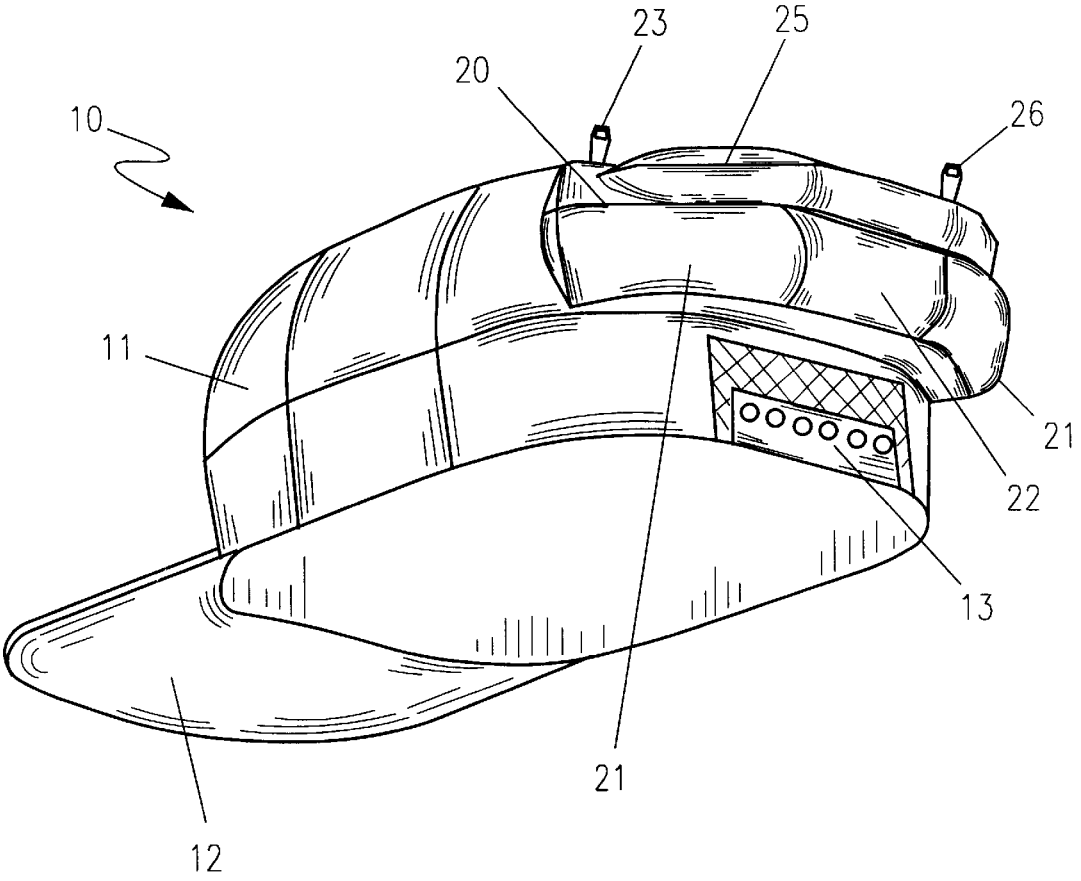
FIG. 3 is a perspective view depicting a bottom view of the cap with integrated storage pouches according to the preferred embodiment of the present invention.
Figure 4:
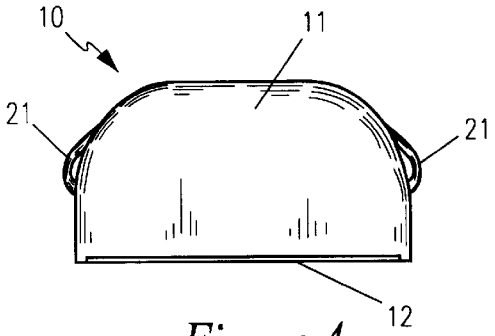
FIG. 4 is a front elevational view of the cap with integrated storage pouches according to the preferred embodiment of the present invention.
Figure 5:
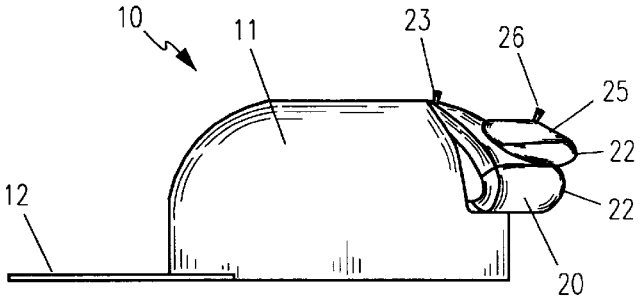
FIG. 5 is a side elevational view of the cap with integrated storage pouches according to the preferred embodiment of the present invention.
Figure 6:
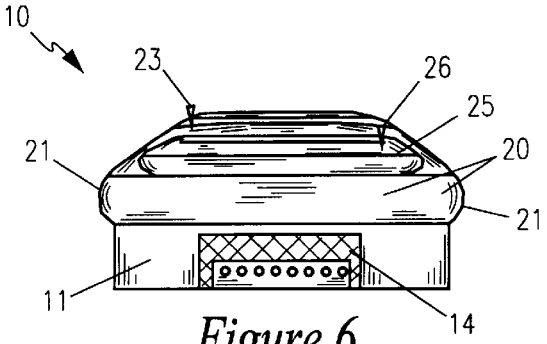
FIG. 6 is a rear elevational view of the cap with integrated storage pouches according to the preferred embodiment of the present invention.
Figure 7:
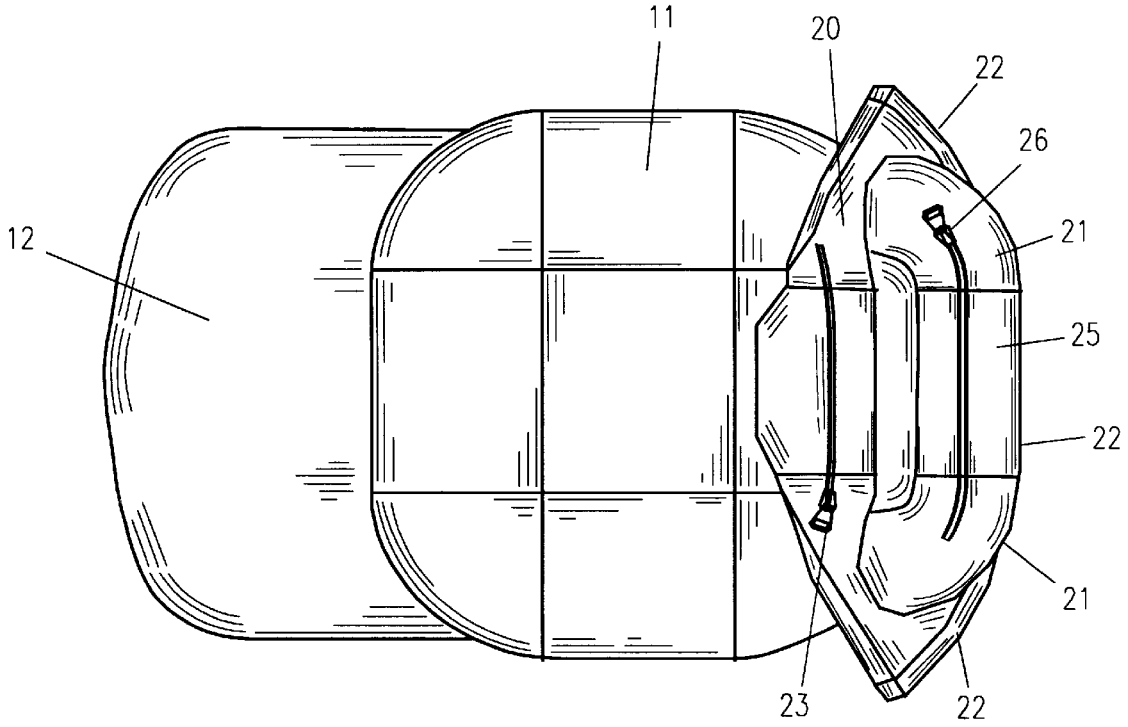
FIG. 7 is a top elevational view of the cap with integrated storage pouches according to the preferred embodiment of the present invention.
Figure 8:
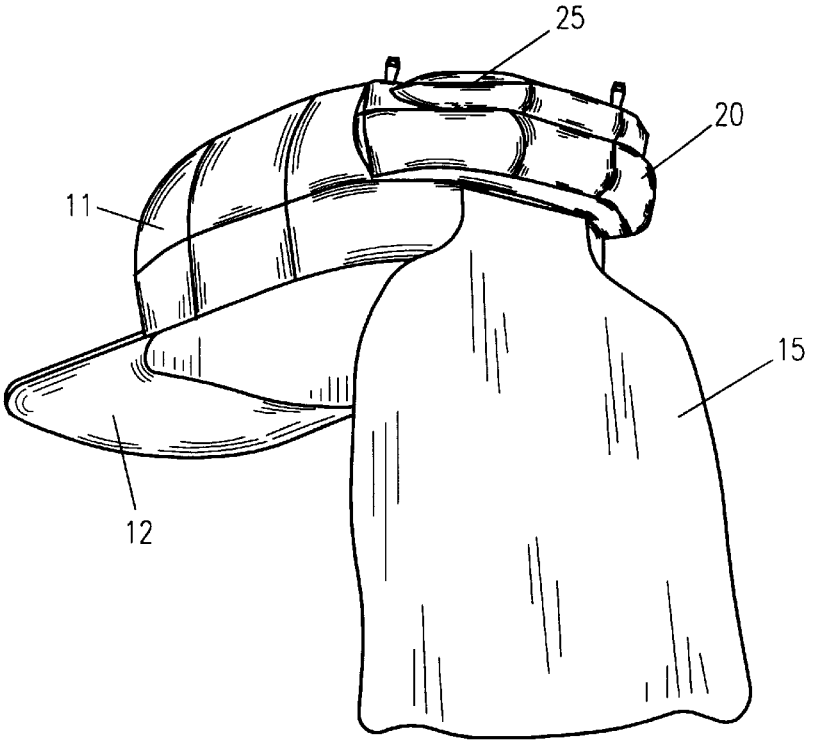
FIG. 8 is a perspective view depicting a bottom view of the cap with integrated storage pouches with an optional neck shade attachment installed according to the preferred embodiment of the present invention.
Figure 9:
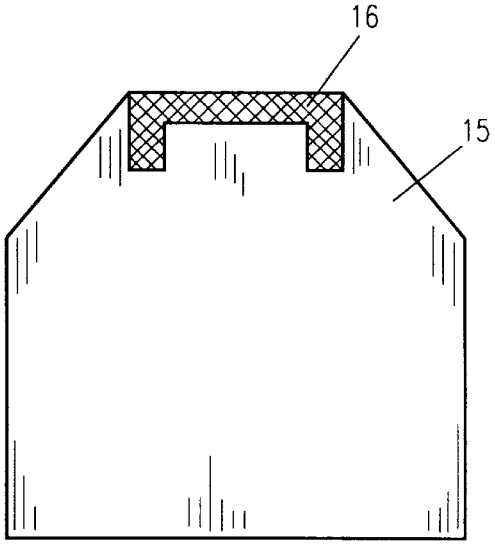
FIG. 9 is a front elevational view of the neck shade attachment for use with the cap with integrated storage pouches according to the preferred embodiment of the present invention.

10 Sports Cap With Integrated Pouches
11 Dome-Shaped Hat Body
12 Brim
13 Adjustment Band
14 First Neck Shade Attachment Strap
15 Neck Shade
16 Second Neck Shade Attachment Strap
20 Large Waterproof Pouch
21 Rounded Corners
22 Rounded Edges
23 Large Pouch Zipper
25 Small Waterproof Pouch
26 Small Pouch Zipper

DESCRIPTION OF THE PREFERRED EMBODIMENTS

In order to describe the complete relationship of the invention, it is essential that some description be given to the manner and practice of functional utility and description thereof. Accordingly, the best mode for carrying out the invention is presented in terms of its preferred embodiment, herein depicted within the figures.

1. Detailed Description of the Figures

Referring now to the figures, depicted is a sports cap with integrated pouches, hereinafter cap 10. The cap 10 resembles an otherwise conventional baseball cap-like hat with a dome-shaped hat body, hereinafter hat body 11, a brim 12 and an adjustment band 13 so as to accommodate a variety of wearer's head sizes. A first neck shade attachment strap, hereinafter first attachment strap 14, consisting of one component of a hook and loop fastening device is attached to the rear of the cap 10 around the perimeter of the adjustment band 13 portion thereof. The first attachment strap 14 is used to secure a neck shade 15 to the rear of the cap 10, thus protecting the neck of the wearer from the harmful effects of sunlight. The neck shade 15 is a generally rectangular piece of cloth material with the top portion being tapered towards the center where a second neck shade attachment strap, hereinafter second attachment strap 16 is located. The second attachment strap 16 is of a similar shape as that of the first attachment strap 14, so as to coincide therewith, and is comprised of the component of a hook and loop fastening device counterpart to that of the first attachment strap 14. The neck shade 15, first attachment strap 14 and second attachment strap 16 can be provided optionally and made available on models that include such neck shading features.

A large waterproof pouch, hereinafter large pouch 20, is affixed to the rear of the cap 10 in a position just above the attachment strap 14. The large pouch 20 is generally trapezoidal in shape with rounded corners 21 and rounded edges 22 and attached to the cap 10 with the shorter of the parallel edges located at the top of the pouch, oriented horizontally. The large pouch 20 is attached to the cap 10 so as to mate with the cap body 11, following the dome-like contour of the cap structure spanning across the rear portion thereof. A large pouch zipper 23 provides access to the interior cavity (not shown) of the large pouch 20. The large pouch zipper 22 is designed such that, when closed, a water tight seal is created, thus isolating the interior cavity from the effects of moisture, including complete submersion.

A small waterproof pouch, hereinafter small pouch 25, is affixed to the outer surface of the large pouch 20 in a position just below the large pouch zipper 22. The small pouch 25 is generally elongated in shape with rounded corners and edges and attached to the surface of the large pouch 20 with the longer dimension spanning across it horizontally. The small pouch 25 is attached to the surface of the large pouch 20 so as to mate with the shape thereof, following its contour. A small pouch zipper 26 provides access to the interior cavity of the small pouch 25. The small pouch zipper 26 is designed such that, when closed, a water tight seal is created, thus isolating the interior cavity from the effects of moisture, including complete submersion.

The large pouch 20 and the small pouch 25 are constructed of flexible, waterproof materials and/or fabrics. Accordingly, the pouches are designed to accept objects of varying sizes and shapes and will assume the shape of these objects as required. Furthermore, the large pouch 20 and the small pouch 25 will also conform to the shape of the wearer's head as it is worn. As a result, a comfortable fit is achieved regardless of the contents of the pouches.

2. Operation of the Preferred Embodiment

In accordance with the preferred embodiment of the present invention, the cap 10 is worn in a manner similar to an otherwise conventional cap-like hat. The wearer can adjust the size of the cap 10 by altering the adjustment strap 13 to achieve the appropriate hat diameter. Placing personal items in both the large pouch 20 and the small pouch 25, the wearer can store and transport them while wearing the cap 10, assured that the items are protected from rain and other forms of moisture, including complete submersion. Additionally, the wearer can afford him/herself protection from exposure of the rear neck and head areas to the harmful effects of exposure to sunlight by use of the optional neck shade 15, attaching it to the rear of the cap 10.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A sportsman's cap, with two weatherproof storage pouches affixed thereto, said cap comprising:

a head covering portion, said head covering portion generally dome-shaped forming an interior head receiving cavity opposite a head covering exterior surface, said head covering portion having an outwardly extending front brim opposite a rear adjustment strap;

a first neck shade attaching strap, said first neck shade attaching strap comprising a generally rectangular hook and loop fastening device, said first neck shade attaching strap attached to said head covering exterior surface occupying a space around the perimeter of said rear adjustment strap;

a neck shade, said neck shade being generally rectangular in shape with a top edge opposite a bottom edge, said top edge being tapered towards the center thereof;

a second neck shade attaching strap, said second neck shade attaching strap comprising a generally rectangular hook and loop fastening device attached to said top edge of said neck shade, said second neck shade attaching strap mating with said first shade attaching strap securing said neck shade to said head covering exterior surface;

a large storage compartment, said large storage compartment having a generally trapezoidal shape, horizontally oriented with rounded corners and edges forming a large storage compartment interior cavity opposite a large storage compartment exterior surface, said large storage compartment attached to said head covering exterior surface above said neck shade attaching means; and a small storage compartment, said small storage compartment having a generally elongated shape, horizontally oriented with rounded corners and edges forming a small storage compartment interior cavity opposite a small storage compartment exterior surface, said small storage compartment attached to said large storage compartment exterior surface.

2. The cap of claim 1, wherein said large storage compartment further comprises:

a large storage compartment interior cavity access aperture, said large storage compartment interior cavity access aperture being generally elongated and providing fluid connectivity between said large storage compartment interior cavity and said large storage compartment exterior surface; and a large storage compartment access zipper, said large storage compartment access zipper comprising a sliding connector forming a recloseable waterproof seal of said large storage compartment interior cavity access aperture.

3. The cap of claim 2, wherein said large storage compartment is constructed of a material selected from the group comprising waterproof fabrics.

4. The cap of claim 1, wherein said small storage compartment further comprises:

a small storage compartment interior cavity access aperture, said small storage compartment interior cavity access aperture being generally elongated and providing fluid connectivity between said small storage compartment interior cavity and said small storage compartment exterior surface; and a small storage compartment access zipper, said small storage compartment access zipper comprising a sliding connector forming a recloseable waterproof seal of said small storage compartment interior cavity access aperture.

5. The cap of claim 4, wherein said small storage compartment is constructed of a material selected from the group comprising waterproof fabrics.

* * * * *